US011181113B2

(12) United States Patent
Mizunoue et al.

(10) Patent No.: US 11,181,113 B2
(45) Date of Patent: Nov. 23, 2021

(54) ROTARY MACHINE

(71) Applicant: MITSUBISHI HEAVY INDUSTRIES COMPRESSOR CORPORATION, Tokyo (JP)

(72) Inventors: Toshio Mizunoue, Tokyo (JP); Takanori Matsueda, Hiroshima (JP); Daisuke Hirata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 372 days.

(21) Appl. No.: 16/242,214

(22) Filed: Jan. 8, 2019

(65) Prior Publication Data

US 2019/0249675 A1 Aug. 15, 2019

(30) Foreign Application Priority Data

Feb. 15, 2018 (JP) ..... JP2018-024936

(51) Int. Cl.

| | |
|---|---|
| ***F01D 25/24*** | (2006.01) |
| ***F04D 17/12*** | (2006.01) |
| ***F04D 29/42*** | (2006.01) |
| ***F04D 29/62*** | (2006.01) |
| ***F04D 29/08*** | (2006.01) |
| *F04D 29/40* | (2006.01) |

(52) U.S. Cl.

CPC ..... *F04D 17/122* (2013.01); *F01D 25/24* (2013.01); *F04D 29/083* (2013.01); *F04D 29/4206* (2013.01); *F04D 29/624* (2013.01); *F01D 25/243* (2013.01); *F04D 29/403* (2013.01); *F05B 2240/14* (2013.01); *F05B 2260/301* (2013.01)

(58) Field of Classification Search

None

See application file for complete search history.

(56) References Cited

U.S. PATENT DOCUMENTS

| | | | | |
|---|---|---|---|---|
| 5,230,540 | A * | 7/1993 | Lewis | F02K 1/80 285/363 |
| 10,975,728 | B2 * | 4/2021 | Mizunoue | F04D 29/406 |
| 2007/0183892 | A1 * | 8/2007 | Sorokes | F04D 17/125 415/214.1 |

(Continued)

FOREIGN PATENT DOCUMENTS

| | | |
|---|---|---|
| JP | S52-119704 A | 10/1977 |
| JP | S58-098405 U | 7/1983 |

(Continued)

OTHER PUBLICATIONS

Notice of Reasons for Refusal in corresponding Japanese Application No. 2018-024936, dated Sep. 7, 2021 (8 pages).

*Primary Examiner* — Kayla McCaffrey

(74) *Attorney, Agent, or Firm* — Osha Bergman Watanabe & Burton LLP

(57) ABSTRACT

A rotary machine includes a first flange in which a first hole portion is formed, a second flange disposed to face the first flange via an abutting surface and having a second hole portion formed therein, and a stud bolt inserted into a first hole portion and a second hole portion and fastened to a female screw of the second hole portion, wherein the thickness of the second flange is larger than the thickness of the first flange.

11 Claims, 4 Drawing Sheets

(56) References Cited

U.S. PATENT DOCUMENTS

| | | | | |
|---|---|---|---|---|
| 2018/0283385 | A1* | 10/2018 | Mizunoue | F04D 17/122 |
| 2019/0055855 | A1* | 2/2019 | Tanno | F01D 25/243 |

FOREIGN PATENT DOCUMENTS

| | | | | | |
|---|---|---|---|---|---|
| JP | S63-014090 | U | | 1/1988 | |
| JP | S63-065804 | U | | 4/1988 | |
| JP | H07-204960 | A | | 8/1995 | |
| JP | H11-324614 | A | | 11/1999 | |
| JP | 2010209750 | A | * | 9/2010 | G06F 40/242 |
| JP | 4576817 | B2 | | 11/2010 | |
| JP | 2013249771 | A | * | 12/2013 | |
| JP | 2015042881 | A | * | 3/2015 | F16B 31/043 |
| JP | 2016-040452 | A | | 3/2016 | |
| JP | 2017-089455 | A | | 5/2017 | |
| JP | 2018-168740 | A | | 11/2018 | |

* cited by examiner

ROTARY MACHINE

CROSS-REFERENCE TO THE RELATED APPLICATION

Priority is claimed on Japanese Patent Application No. 2018-024936, filed Feb. 15, 2018, the content of which is incorporated herein by reference.

BACKGROUND OF THE DISCLOSURE

Field of the Disclosure

The present disclosure relates to a rotary machine.

Description of Related Art

A compressor, which is a type of rotary machine, includes a rotary shaft rotating around an axis, a plurality of impellers attached to the rotary shaft, and a casing which covers the impeller from an outer circumferential side and forms a flow path through which a working fluid flows.

The rotary shaft and the impeller are rotated by a driving force given from the outside. With rotation of the impeller, the working fluid flows in the flow path from an upstream side to a downstream side and is sequentially compressed in the course thereof to become a high-pressure fluid.

In general, the casing adopts a configuration in which it is divided into, for example, two parts in a vertical direction. That is, when assembling the compressor, after the rotary shaft and the impeller are accommodated in a lower casing half, these are covered with an upper casing half. In many cases, the casing halves are fastened by bolts via flanges extending on a horizontal plane.

Regarding a fastening structure of a rotary machine (a compressor), certain standards (e.g., an API standard: American Petroleum Institute Standard) standardize its form.

According to the API standard, from the viewpoint of ensuring sealing properties with respect to the working fluid when fastening the casing halves of the compressor, it is defined that an implant bolt be used. In other words, the use of through-bolts that connect flanges together regarding nuts and bolts is prohibited.

Further, a fastening structure using an implant bolt refers to a structure which fastens a female screw disposed in the entire bolt hole formed in the flange on one side and a shaft portion of the implant bolt.

Incidentally, an implant bolt has limited drag in response to a force of the bolt in an axial direction. In particular, compared with a structure using a through-bolt, a structure using an implant bolt has a small drag in the axial direction. For this reason, in a machine having a high internal pressure such as a compressor, in some cases, the through-bolt structure described in Patent Document 1 may be used from the viewpoint of the axial force (tightening force) of the bolt.

PATENT DOCUMENTS

Patent Document 1: Japanese Utility Model Application Laid-Open No. S58-98405

However, in the through-bolt structure described in Patent Document 1, it is necessary to fasten nuts to the bolts from both sides of the flange. For this reason, in view of operability, the through-bolt structure is inferior to an implant bolt structure in which a fastening operation is performed only on one side of the flange. For this reason, it is desired to improve the operation efficiency of the fastening operation.

The present disclosure has been made to solve the above problems, and an object of the present disclosure is to provide a rotary machine in which an operation efficiency of the fastening operation is able to be improved.

SUMMARY OF THE DISCLOSURE

A rotary machine according to an aspect of the present disclosure includes: a casing having first and second casing half-bodies abutting each other via an abutting surface therebetween, a first flange which is a part of the first casing half-body extending along the abutting surface and in which a first hole portion is formed, and a second flange which is a part of the second casing half-body extending along the abutting surface and in which a second hole portion corresponding to the first hole portion is formed; and a first bolt inserted into the first and second hole portions and fastened to a first female screw formed in at least a part of the second hole portion. The first hole portion is passed through the first flange, the second hole portion is formed to be shallower in depth than the thickness of the second flange. The second flange has a first portion which is thicker than the first flange in a direction in which the second hole portion extends.

According to the present disclosure, with the above-described configuration, since the first bolt needs to be fastened only from the first flange side, the operation efficiency of the fastening operation can be improved as compared with a structure in which a fastening operation is required from both sides of the flange structure including the first flange and the second flange.

It is known that the size of the region in which the tightening force of the first bolt is applied inside the flange structure is proportional to the length of the shaft portion of the first bolt. In the above configuration, since the thickness of the second flange is larger than the thickness of the first flange, it is possible to enlarge the region in which the tightening force of the first bolt is applied inside the flange structure.

Further, in the rotary machine, the first female screw may be formed at a bottom part of the second hole portion.

Since the first female screw is formed at the bottom part of the second hole portion, it is possible to further enlarge the region in which the tightening force of the first bolt is applied inside the flange structure.

Further, in the rotary machine, the first female screw may be formed at a position deeper than the thickness of the first flange with respect to the abutting surface of the second casing half-body.

Since the first female screw is formed at a position deeper than the thickness of the first flange with respect to of the abutting surface, it is possible to expand the region in which the tightening force of the first bolt is applied inside the flange structure.

In the rotary machine, the second flange may be have a second portion which is thinner than the first portion around the first portion, a third hole portion passing through a portion of the first flange corresponding to the second portion may be formed in the first flange, and a fourth hole portion corresponding to the third hole portion, which is shallower in depth than the thickness of the second portion, may be formed in the second portion, a second female screw being formed in at least a part of the fourth hole portion. Further, the rotary machine further may include a second bolt inserted into the third and fourth hole portions and fastened to the second female screw.

In order to avoid concentration of stress inside the flange structure, it is desirable that regions on which the tightening force is applied do not overlap between mutually adjacent bolts. That is, it is required that a certain interval be formed between adjacent bolts.

Therefore, with the above configuration, since the lengths of the shaft portion of the first bolt and the shaft portion of the second bolt are different from each other, it is possible to make the range of the region in which the tightening force of the first bolt is applied different from the range of the region in which the tightening force of the second bolt is applied.

Since this makes it possible to reduce the interval between the bolts (the interval between the first bolt and the second bolt) as compared with a case where bolts of the same length are disposed at mutually adjacent positions, it is possible to increase the number of bolts (the number of first bolts and second bolts) arranged per unit area. Therefore, it is possible to enhance the sealing property between the first flange and the second flange.

In the rotary machine, the second female screw may be formed at the bottom part of the fourth hole portion.

Since the second female screw is formed at the bottom part of the fourth hole portion, it is possible to further enlarge the region in which the tightening force of the first bolt and the second bolt is applied inside the flange structure.

Further, the rotary machine may be a compressor equipped with a rotor configured to rotate around an axis extending along the abutting surface, a suction port to which working fluid is introduced may be formed on one side of the casing in a direction in which the axis extends, and a discharge port from which compressed high-pressure working fluid is discharged may be formed on the other side of the casing. Further, the first portion may be provided in a region including a position corresponding to the discharge port in the direction in which the axis extends.

The compressor as the rotary machine compresses a working fluid introduced from a suction port with rotation of the rotor and discharges the working fluid in a high-pressure state from a discharge port. That is, in the region including the position corresponding to the discharge port in the direction in which the axis extends, since a high internal pressure is applied to the casing, excellent sealing performance is required between the flanges. In the above configuration, since the first portion is provided on the other flange in the region, the region in which the tightening force of the bolt is applied inside the flange is enlarged, and high sealing performance can be secured.

According to the present disclosure, it is possible to easily perform a bolt fastening operation in a vehicle interior.

DETAILED DESCRIPTION OF THE DISCLOSURE

First Embodiment

Figure 1:
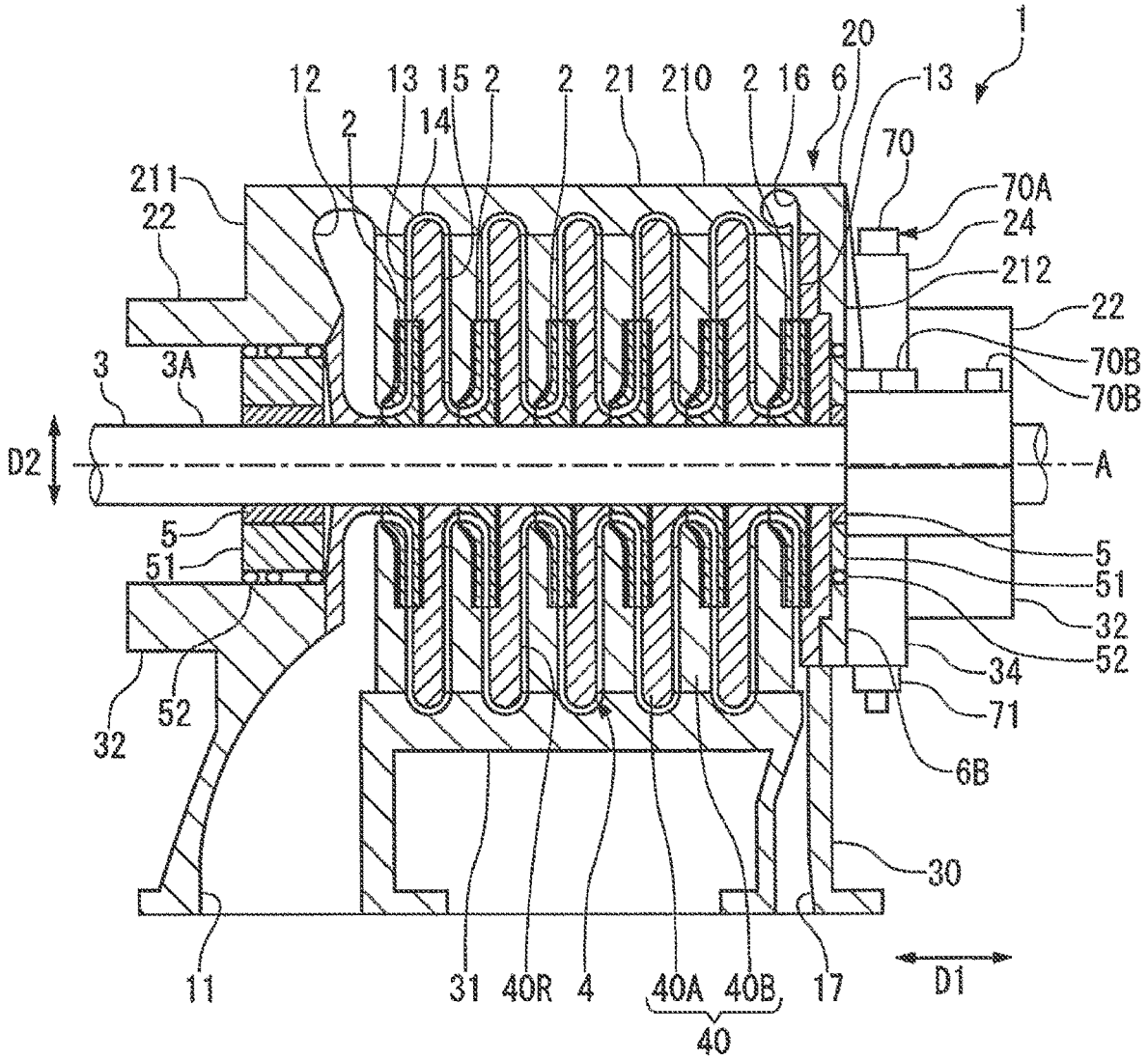
FIG. 1 is a cross-sectional view showing a configuration of a centrifugal compressor according to a first embodiment of the present disclosure.

A centrifugal compressor 1 which is a rotary machine according to a first embodiment of the present disclosure will be described with reference to FIG. 1. In FIG. 1, reference numeral A represents an axis of a rotary shaft 3A (hereinafter referred to as "axis A"), and reference numeral D1 represents an axial direction (hereinafter referred to as an "axial direction D1") which is a direction along the axis A.

The centrifugal compressor 1 (rotary machine) is a multistage compressor and has a plurality of impellers 2. The centrifugal compressor 1 is incorporated in a plant facility or the like, and compresses and discharges a process gas to be introduced.

The centrifugal compressor 1 includes a rotor 3 having a plurality of impellers 2, a diaphragm group 4, a sealing device 5, and a casing 6 having an upper half casing 20 as a first casing half-body and a lower half casing 30 as a second casing half-body.

The rotor 3 has a rotary shaft 3A extending in a horizontal direction, and a plurality of impellers 2 coupled to an outer circumferential portion of the rotary shaft 3A. Both end portions of the rotary shaft 3A are supported by unshown bearings installed outside of the casing 6.

When the rotary shaft 3A is rotated by a driving source such as a motor connected to the rotary shaft 3A, the plurality of impellers 2 are rotationally driven. Due to the centrifugal force accompanying the rotation, each impeller 2 compresses the process gas (working fluid).

The diaphragm group 4 includes a plurality of diaphragms 40 arranged along the axial direction D1 corresponding to each of a plurality of stages of impellers 2. The diaphragm 40 includes members 40A and 40B connected via a return vane 40R.

The diaphragm group 4 covers the impeller 2 from the outer circumferential side. The diaphragm 40 and an inner wall of the casing 6 define a flow path which communicates with the flow path of the impeller 2 to allow the process gas to pass therethrough.

The process gas suctioned into the casing 6 from a suction port 11 by the rotation of the rotor 3 flows into the impeller 2 of an initial stage via a suction flow path 12, flows outward in a radial direction from an outlet of the flow path of the impeller 2 due to a diffuser flow path 13, and further flows through a bent flow path 14 and a return flow path 15 to an inlet of a flow path located on an inner circumferential side of the impeller 2 of the next stage.

Further, the process gas repeatedly flows into an impeller 2 of the next stage via the flow path of the impeller 2, the diffuser flow path 13, the bent flow path 14, and the return flow path 15, and the process gas is discharged from the impeller 2 of the last stage outside of the casing 6 through the discharge port 17 via the diffuser flow path 13 and a discharge volute 16.

Further, the suction port 11 is formed on one side of the casing 6, and the discharge port 17 is formed on the other side of the casing 6.

The discharge volute 16 is formed annularly over the entire casing 6 in the circumferential direction. The discharge volute 16 is formed to spread toward the inner side (the upstream side) in the axial direction D1 with respect to a position on the extension of the diffuser flow path 13 through which the high-pressure gas flowing out from the impeller 2 of the final stage flows.

By defining the expanding direction of the discharge volute 16 in the axial direction D1, the rear end portion of the casing 6 is prevented from expanding toward the downstream side in the axial direction D1. A rear end portion of the upper half casing 20 of the casing 6 has a base 24 which is taller than a first flange 61 (see FIG. 2) of the upper half casing 20, and the rear end portion of the lower half casing 30 has a base 34 which is taller than the second flange 62 (see FIG. 2) of the lower half casing 30.

The sealing device 5 prevents the process gas from leaking to the outside of the casing 6 by sealing between the outer circumferential portion of the rotary shaft 3A and the casing 6 over the entire circumference. For example, a labyrinth seal is suitable as the sealing device 5.

The sealing device 5 is disposed on each of both end sides of the rotary shaft 3A, and is held by a seal housing holder 51. A space between an outer circumferential portion of the seal housing holder 51 and the casing 6 is sealed by a seal member 52.

The casing 6 is formed in a substantially cylindrical shape, accommodates the rotor 3 and the diaphragm group 4 therein, and surrounds the outer circumferential portion of the seal housing holder 51. It is desirable that the casing 6 be formed of, for example, a metal having corrosion resistance with respect to the process gas with which it comes into contact. The casing 6 of the present embodiment may be made of, for example, stainless steel.

Figure 2:
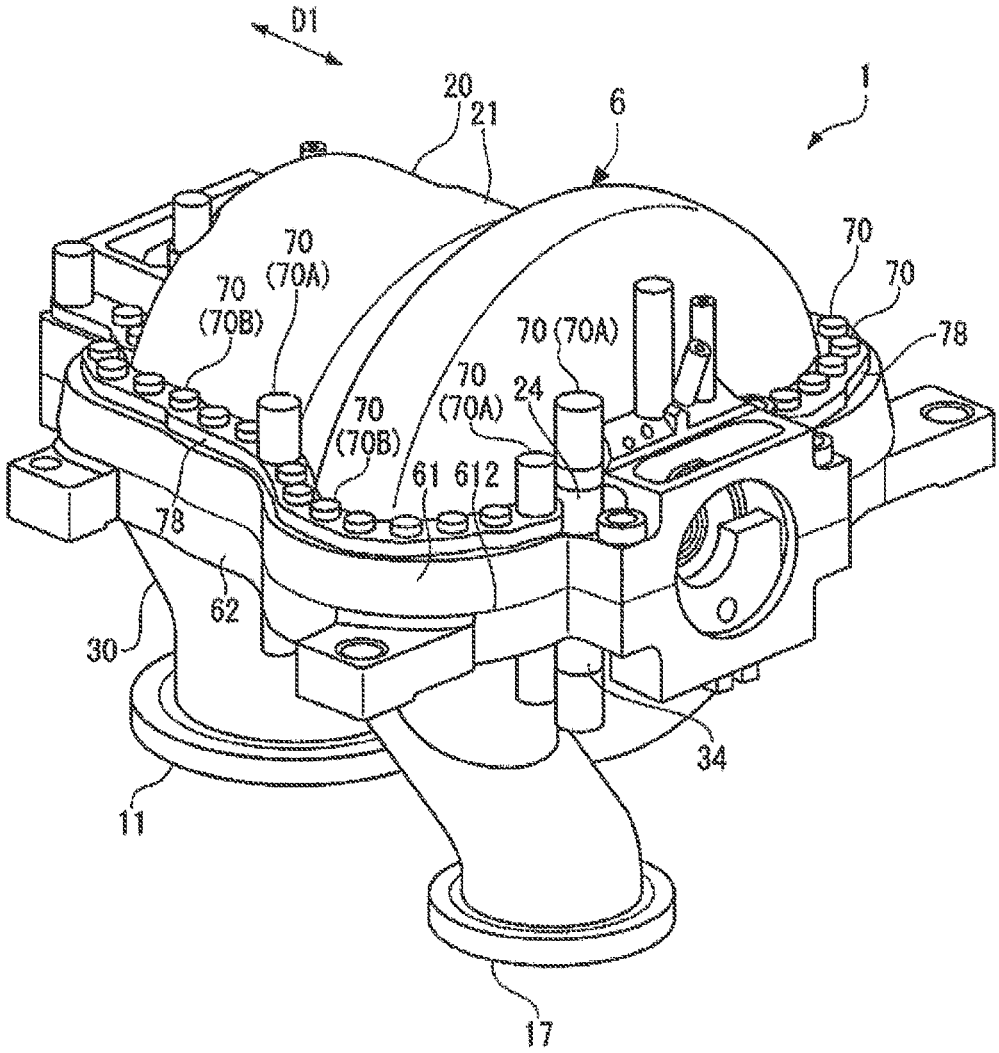
FIG. 2 is a perspective view showing a configuration of the centrifugal compressor according to the first embodiment of the present disclosure.

As shown in FIG. 1 or FIG. 2, the casing 6 includes an upper half casing 20 and a lower half casing 30 that are partitioned from each other along a horizontal plane including the axis A. The upper half casing 20 has a first flange 61 which is a part of the upper half casing 20 extending along an abutting surface existing between the casings 20, 30. The lower half casing 30 has a second flange 62 which is a part of the lower half casing 30 extending along the abutting surface.

The upper half casing 20 is integrated with the lower half casing 30 by fastening the first flange 61 and the second flange 62.

Figure 3:
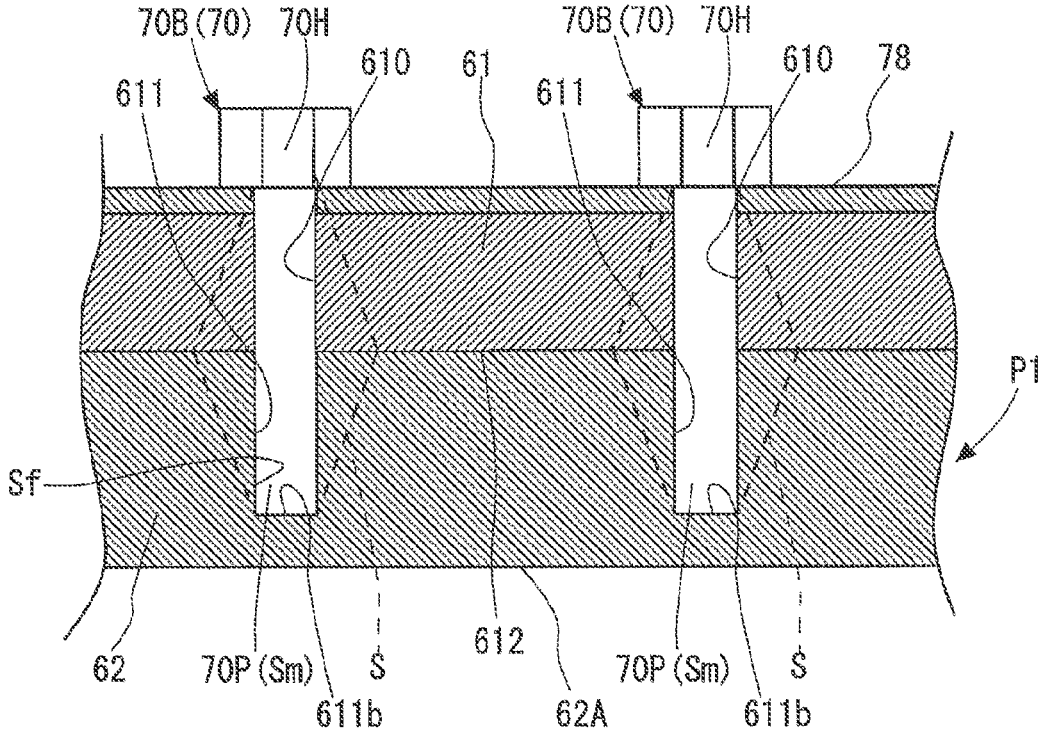
FIG. 3 is an enlarged sectional view of a main part of the centrifugal compressor according to the first embodiment of the present disclosure.

As shown in FIGS. 1 and 3, the upper half casing 20 includes an accommodating portion 21 which accommodates the rotor 3 and the diaphragm group 4, a surrounding portion 22 which surrounds the seal housing holder 51, and the first flange 61 which protrudes outward in the horizontal direction from the lower end of the accommodating portion 21 and the surrounding portion 22.

The accommodating portion 21 has a semi-cylindrical circumferential wall 210, a front side wall 211 that closes a front end of the circumferential wall 210, and a rear side wall 212 that closes a rear end of the circumferential wall 210. The surrounding portion 22 is formed in a semi-cylindrical shape having a diameter smaller than that of the accommodating portion 21, and is disposed on each of a front side (upstream side) of the accommodating portion 21 and a rear side (downstream side) of the accommodating portion 21.

The first flange 61 is disposed over all lower end portions of the accommodating portion 21 and the surrounding portion 22. A plurality of first hole portions 610 (see FIG. 3) into which each of the bolts 70 are inserted are formed in the first flange 61. Each of the plurality of first hole portions 610 passes through the first flange 61.

A plurality of first hole portions 610 are arranged at intervals over the entire circumference of the first flange 61. The bolts 70 used for fastening the upper half casing 20 and the lower half casing 30 are inserted into the plurality of first hole portions 610.

Further, the bolt 70 includes a through-bolt 70A (see FIG. 2) passing through the first flange 61 and the second flange 62, and a stud bolt 70B (a first bolt) to be described later which passes through the first flange 61 and engages with the female screw of the second flange 62.

As shown in FIG. 2 or FIG. 3, a washer 78 is interposed between the bolt 70 and the first flange 61 on the upper surface side of the first flange 61.

The washer 78 uniformly distributes the tightening force of the bolt 70 over the entirety of the first flange 61. Specifically, the washer 78 has a plate shape having a planar shape corresponding to the first flange 61. It is also possible to adopt a configuration of not using the washer 78.

Similar to the above-described upper half casing 20, the lower half casing 30 includes an accommodating portion 31, a surrounding portion 32 which surrounds the seal housing holder 51, and the second flange 62 which protrudes outward in the horizontal direction from the lower ends of the accommodating portion 31 and the surrounding portion 32.

A second hole portion 611 into which the stud bolt 70B is inserted is formed in the second flange 62. An opening of the second hole portion 611 is formed on the upper surface of the second flange 62, and the second hole portion 611 extends from the upper surface of the second flange 62 toward the lower surface of that.

The second hole portion 611 does not pass through the second flange 62, and an inner bottom surface 611*b* of the second hole portion 611 is located in a region separated upward from the lower surface of the second flange 62.

In other words, the second hole portion 611 is formed to be shallower in depth than the thickness of the second flange 62.

Furthermore, a female screw Sf (a first female screw) which engages with a male screw Sm formed on a distal end portion 70P of the stud bolt 70B is formed only in a portion including the end portion on the bottom surface 611*b* side of the inner circumferential surface of the second hole portion 611. More specifically, a female screw Sf is formed only at the bottom part of the second hole portion 611.

That is, the stud bolt 70B is inserted into the first hole portion 610 of the first flange 61 and the second hole portion 611 of the second flange 62 of the lower half casing 30, and the male screw Sm is fastened to the female screw Sf of the second hole portion 611.

In this way, by forming the female screw Sf at the bottom part of the second hole portion 611 and fastening the male screw Sm and the female screw Sf formed at the distal end portion 70P of the stud bolt 70B to each other, it is possible to further enlarge the region in which the tightening force of the stud bolt 70B is applied inside the flange structure including the first flange 61 and the second flange 62.

Further, the female screw Sf may be formed at a position deeper than the thickness of the first flange 61 with respect to the abutting surface 612.

By forming the female screw Sf at such a position, it is possible to further enlarge the region in which the tightening force of the stud bolt 70B is applied inside the flange structure including the first flange 61 and the second flange 62.

The upper surface of the second flange 62 of the lower half casing 30 and the lower surface of the first flange 61 of the upper half casing 20 are in contact with each other in the vertical direction.

In the following description, the abutting surface between the upper surface of the second flange 62 and the lower surface of the first flange 61 is referred to as a abutting surface 612 (see FIGS. 2 and 3) between the first flange 61 and the second flange 62. The abutting surface 612 spreads smoothly in the horizontal direction.

As shown in FIG. 3, the thickness (a dimension in a direction in which the first hole portion 610 and the second hole portion 611 extend) of the second flange 62 has a first portion P1 that is larger than the thickness of the first flange 61.

Next, the operation of the centrifugal compressor 1 will be described.

As the rotary shaft 3A rotates by a driving source such as a motor connected to the rotary shaft 3A, the plurality of impellers 2 are rotationally driven. Using the centrifugal force accompanying the rotation, the process gas (working fluid) is compressed by each impeller 2.

Here, as described above, a high-pressure working fluid circulates inside the centrifugal compressor 1. If a gap is formed between the upper half casing 20 and the lower half casing 30, the working fluid leaks outside through the gap even if the gap is small and the efficiency of the centrifugal compressor 1 is thus impaired.

In particular, the pressure of the working fluid is higher in the portion on the downstream side closer to the discharge port 17 in the direction of the axis A.

Therefore, in this portion, it is necessary to sufficiently seal the space between the first flange 61 and the second flange 62, by fastening the upper half casing 20 and the lower half casing 30 with a large tightening force.

Therefore, as described above, the thickness of the second flange 62 is larger than the thickness of the first flange 61.

As shown in FIG. 3, a region S in which the tightening force of the bolt is applied inside the first flange 61 and the second flange 62 gradually enlarges from the head portion 70H side to the abutting surface 612 around the stud bolt 70B, and gradually reduces from the abutting surface 612 to the distal end portion 70P.

Further, the size of the region S to which the tightening force is applied is proportional to the length (the total depth of the depth of the first hole portion 610 and the depth of the second hole portion 611) of the shaft portion of the bolt 70.

That is, according to the above configuration, the region S in which the tightening force of the bolt 70 is applied can be enlarged in the length direction of the bolt 70 in accordance with the thickness of the second flange 62 is thicker than the first flange 61. As a result, the tightening force between the first flange 61 and the second flange 62 increases, and a tightening force equivalent to that of the through-bolt 70A can be secured with the stud bolt 70B. Therefore, the sealing performance on the abutting surface 612 can be improved.

Furthermore, since the tightening operation may be performed only on one side (the first flange 61 side), the operation efficiency of the fastening operation can be improved as compared with the through-bolt 70A which requires a tightening operation on both sides of the flange.

The centrifugal compressor 1 compresses the working fluid introduced from the suction port 11 with rotation of the rotor 3, and discharges the working fluid in a high pressure state from the discharge port 17.

That is, since a high internal pressure is applied to the casing 6 in the region including the position corresponding to the discharge port 17 in the direction in which the axis A extends, a high sealing performance is required between the first flange 61 and the second flange 62.

In the above configuration, since the first portion P1 is provided in the second flange 62 in the region, the region S in which the tightening force of the stud bolt 70B is applied inside the first flange 61 and the second flange 62 is enlarged. Thus, high sealing performance can be secured.

Further, various changes and modifications can be made to the above-described structure and method without departing from the gist of the present disclosure.

Figure 4:
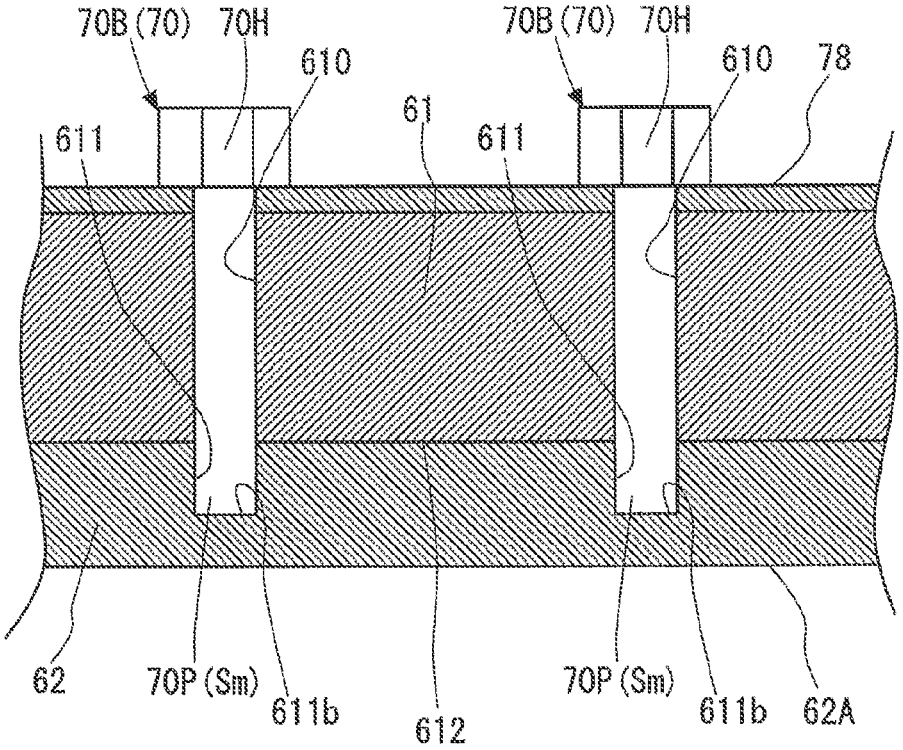
FIG. 4 is an enlarged sectional view of a main part showing a modified example of the centrifugal compressor according to the first embodiment of the present disclosure.

For example, in the first embodiment, description has been given of the case where the thickness of the second flange 62 is thicker than the thickness of the first flange 61 as an example. However, as shown in FIG. 4, it is also possible to adopt a configuration in which the thickness of the first flange 61 is larger than the thickness of the second flange 62.

Further, in the first embodiment, description has been given of the case where the stud bolt 70B is fastened from the upper surface side of the first flange 61 as an example, but a configuration in which the stud bolt 70B is fastened from the lower surface side of the second flange 62 may be adopted. In this case, the first hole portion 610 is formed in the second flange 62, and the second hole portion 611 is formed from the lower surface side of the first flange 61.

Furthermore, in the first embodiment, description has been given of the case of using the centrifugal compressor 1 as an example of the rotary machine, but as long as the rotary machine has the two halves like the casing 6 of the centrifugal compressor 1, any mechanical device can be applied as a rotary machine. As other examples of the rotary machine, for example, a gas turbine, a steam turbine, or the like are exemplary.

Second Embodiment

A second embodiment of the present disclosure will be described with reference to FIG. 5. Components the same as those of the first embodiment are denoted by the same reference numerals, and a detailed description thereof will not be provided.

Figure 5:
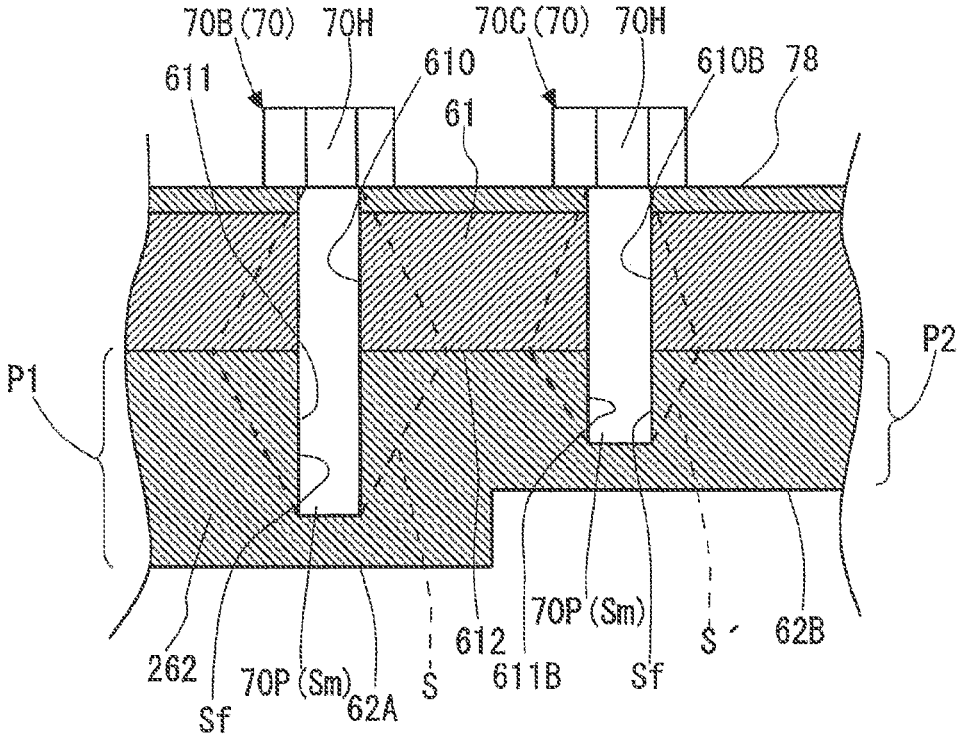
FIG. 5 is an enlarged sectional view of a main part of a centrifugal compressor according to a second embodiment of the present disclosure.

As shown in FIG. 5, the rotary machine of the second embodiment is the same as the centrifugal compressor 1 described in the first embodiment except that the rotary machine of the second embodiment has, in place of the second flange 62 described in the first embodiment, a second flange 262 including a second portion P2 having a thickness thinner than the thickness of the first portion P1 and having a fourth hole portion 611B formed therein, in addition to the first portion P1 (a portion having a thickness thicker than that of the first flange 61), has a third hole portion 610B having the same configuration as the first hole portion 610 formed in a portion of the first flange 61 facing the second portion P2, and further has a stud bolt 70C.

The first portion P1 and the second portion P2 are arranged adjacent to each other. For example, second portions P2 may be disposed on both sides of the first portion P1 to sandwich the first portion P1.

The thickness of the second portion P2 is the same as the thickness of the first flange 61. That is, in a state of a cross-sectional view orthogonal to the abutting surface 612, a flange outer surface 62B (a lower surface) of the second portion P2 is disposed to be closer to the first flange 61 side than a flange outer surface 62A (a lower surface) of the first portion P1 is.

It should be noted that the "same thickness" as used herein does not necessarily mean the exact matching of the thicknesses, but errors or manufacturing tolerances are permitted.

The fourth hole portion 611B is a hole portion having a depth shallower than the second hole portion 611 formed in the first portion P1. A female screw Sf (a second female screw) is formed at the bottom part of the fourth hole portion 611B. A stud bolt 70C (a second bolt) having a length of an axial portion shorter than the previously described stud bolt 70B is inserted into the third hole portion 610B and the fourth hole portion 611B.

A male screw Sm is formed on the distal end portion 70P of the stud bolt 70C. The male screw Sm of the stud bolt 70C is fastened to a female screw Sf formed at the bottom part of the fourth hole portion 611B.

In this way, by forming the female screw Sf at the bottom part of the fourth hole portion 611B and by fastening the male screw Sm and the female screw Sf formed at the distal end portion 70P of the stud bolt 70C, it is possible to further enlarge the region in which the tightening force of the stud bolt 70B and the stud bolt 70C is applied inside the flange structure including the first flange 61 and the second flange 262.

As the position in which the second portion P2 is provided, a position near the rear end portion 6B of the casing 6 on which the discharge port 17 is located (specifically, a region including a position corresponding to the discharge port 17 in the axial direction D1, and closest to the rotary shaft 3A in the radial direction) is particularly desirable.

Meanwhile, it is known that the size of the region S (S') in which the tightening force of the bolt 70 is applied inside the first flange 61 and the second flange 262 is proportional to the length of the bolt 70 (that is, the length of the shaft portion of the stud bolts 70B and 70C).

Further, in order to avoid concentration of stress inside the first flange 61 and the second flange 262, it is desirable that regions S (S') on which the tightening force is applied do not overlap between mutually adjacent bolts 70. That is, it is required that a certain interval be formed between adjacent bolts 70. On the other hand, in order to ensure sealing performance on the abutting surface 612, it is desirable to dispose as many bolts 70 as possible.

According to the second embodiment, there is a configuration in which the sizes of the regions S and S' in which the tightening force of the bolt 70 is applied are different between the first portion P1 and the second portion P2 adjacent to each other. This makes it possible to reduce the distance between the bolts 70 as compared with the case where the regions S and S' in which the tightening force is applied have the same size.

Since this makes it possible to increase the number of bolts 70 per unit area, the sealing performance on the abutting surface 612 can be further improved.

Further, various changes and modifications can be made to the above-described structure and method without departing from the gist of the present disclosure. For example, in the second embodiment, the example of using the centrifugal compressor 1 as an example of a rotary machine has been described. However, as long as the rotary machine has two halves like the casing 6 of the centrifugal compressor 1, in any mechanical device, the above configuration can be applied for a rotary machine. As other examples of a rotary machine, for example, a gas turbine, a steam turbine, or the like are exemplary.

While preferred embodiments of the disclosure have been described and shown above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

EXPLANATION OF REFERENCES

1 Centrifugal compressor (rotary machine)
2 Impeller
3 Rotor
3A Rotary shaft
4 Diaphragm group
5 Sealing device
6 Casing
6B Rear end portion
11 Suction port
12 Suction flow path
13 Diffuser flow path
14 Bent flow path
15 Return flow path
16 Discharge volute
17 Discharge port
20 Upper half compartment (first casing half-body)
21, 31 Accommodating portion
22, 32 Surrounding portion
24, 34 Base
30 Lower half compartment (second casing half-body)
40 Diaphragm
40A, 40B Member
51 Seal housing holder
61 First flange
62, 262 Second flange
62A, 62B Flange outer surface
70 Bolt
70A Through-bolt
70B, 70C Stud bolt
70H Head
70P Distal end portion
78 Washer
210 Circumferential wall
211 Front side wall
610 First hole portion
611 Second hole portion
611*b* Bottom
611B Fourth hole portion
612 Abutting surface
P1 First portion
P2 Second portion
S, S' Region
Sf Female screw
Sm Male screw

The invention claimed is:

1. A rotary machine comprising:

a casing having first and second casing half-bodies abutting each other via an abutting surface therebetween, a first flange which is a part of the first casing half-body extending along the abutting surface and in which a first hole portion is formed, and a second flange which is a part of the second casing half-body extending along the abutting surface and in which a second hole portion corresponding to the first hole portion is formed;

a first bolt inserted into the first and second hole portions and fastened to a first female screw formed in at least a part of the second hole portion; and a second bolt inserted into a third hole portion and a fourth hole portion and fastened to a second female screw, wherein the first hole portion is passed through the first flange, the second hole portion is formed to be shallower in depth than the thickness of the second flange, the second flange has a first portion which is thicker than the first flange in a direction in which the second hole portion extends, the second hole portion is formed in the first portion, the second flange further has a second portion around the first portion, the second portion being thinner than the first portion and abutting the first flange via the abutting surface, the third hole portion is formed in the first flange and passes through a portion of the first flange corresponding to the second portion, the fourth hole portion corresponds to the third hole portion and is:

shallower in depth than the thickness of the second portion, and formed in the second portion, and the second female screw is formed in at least a part of the fourth hole portion.

2. The rotary machine according to claim 1, wherein the first female screw is formed at a bottom part of the second hole portion.

3. The rotary machine according to claim 2, wherein the first female screw is formed at a position deeper than the thickness of the first flange with respect to the abutting surface of the second casing half-body.

4. The rotary machine according to claim 2, wherein the second female screw is formed at the bottom part of the fourth hole portion.

5. The rotary machine according to claim 1, wherein the first female screw is formed at a position deeper than the thickness of the first flange with respect to the abutting surface of the second casing half-body.

6. The rotary machine according to claim 1, wherein the second female screw is formed at the bottom part of the fourth hole portion.

7. The rotary machine according to claim 5, wherein the second female screw is formed at the bottom part of the fourth hole portion.

8. The rotary machine according to claim 1, wherein the rotary machine is a compressor equipped with a rotor configured to rotate around an axis extending along the abutting surface, a suction port to which working fluid is introduced is formed on one side of the casing in a direction in which the axis extends, and a discharge port from which compressed high-pressure working fluid is discharged is formed on the other side of the casing, and the first portion is provided in a region including a position corresponding to the discharge port in the direction in which the axis extends.

9. The rotary machine according to claim 1, wherein the second portion is provided on both sides of the first portion to sandwich the first portion.

10. The rotary machine according to claim 1, wherein the second hole portion is formed to be deeper in depth than the thickness of the second portion.

11. The rotary machine according to claim 1, further comprising:

through-bolts that pass through the first flange and the second flange, wherein a plurality of bolts each inserted into the first and second hole portions and fastened to the first female screw is disposed between two adjacent ones of the through-bolts.

* * * * *